US008544968B2

(12) United States Patent
Davidson et al.

(10) Patent No.: US 8,544,968 B2
(45) Date of Patent: Oct. 1, 2013

(54) CABINET WITH A SHELF THAT HAS A REMOVABLE SHELF LINER AND END CAP

(75) Inventors: Richard Dean Davidson, Neosho, MO (US); Len Alan Coates, Carthage, MO (US)

(73) Assignee: Marco Group, Inc., Neosho, MO (US)

( * ) Notice: Subject to any disclaimer, the term of this patent is extended or adjusted under 35 U.S.C. 154(b) by 382 days.

(21) Appl. No.: 12/791,838

(22) Filed: Jun. 1, 2010

(65) Prior Publication Data

US 2011/0291540 A1 Dec. 1, 2011

(51) Int. Cl.
*A47B 47/00* (2006.01)

(52) U.S. Cl.
USPC ..... 312/263; 108/90; 108/27

(58) Field of Classification Search
USPC ..... 312/257.1, 264, 108, 111, 263, 365.5; 108/90, 27, 193, 158.12, 59; 211/153, 183, 211/186, 189
See application file for complete search history.

(56) References Cited

U.S. PATENT DOCUMENTS

| | | | | |
|---|---|---|---|---|
| 3,268,284 | A * | 8/1966 | Branciforte | 312/263 |
| 3,379,483 | A * | 4/1968 | Oldford | 312/263 |
| 3,611,548 | A * | 10/1971 | Parris | 29/428 |
| 4,716,840 | A * | 1/1988 | Tringali et al. | 108/27 |
| 4,750,794 | A * | 6/1988 | Vegh | 312/263 |
| 5,228,581 | A * | 7/1993 | Palladino et al. | 211/153 |
| 5,332,611 | A * | 7/1994 | Shanok et al. | 428/122 |
| 5,466,058 | A * | 11/1995 | Chan | 312/111 |
| 5,573,322 | A * | 11/1996 | Wrobel | 312/400 |
| 6,135,581 | A * | 10/2000 | Kopp et al. | 312/140.3 |
| 6,520,514 | B2 * | 2/2003 | Clegg | 280/47.26 |
| 6,928,786 | B2 * | 8/2005 | Orozco | 52/800.12 |
| 6,994,411 | B2 * | 2/2006 | Johnson | 312/408 |
| 7,641,253 | B2 * | 1/2010 | Steiger et al. | 296/24.4 |
| 7,998,549 | B2 * | 8/2011 | Susnjara | 428/119 |
| 8,307,769 | B1 * | 11/2012 | Wescott | 108/27 |
| 2002/0109442 | A1 * | 8/2002 | Hsu | 312/263 |
| 2006/0180056 | A1 * | 8/2006 | Dorholt | 108/90 |
| 2009/0001037 | A1 * | 1/2009 | Wilcock | 211/119.003 |

FOREIGN PATENT DOCUMENTS

GB 2106455 A * 4/1983

* cited by examiner

*Primary Examiner* — Hanh V Tran
(74) *Attorney, Agent, or Firm* — Martin & Associates, LLC; Derek P. Martin

(57) ABSTRACT

A cabinet includes one or more shelves that each include a substrate, a removable shelf liner, and a removable end cap. When the removable shelf liner or removable end cap needs to be replaced, either one or both of the removable shelf liner and removable end cap can be easily removed and replaced without removing or replacing the shelf. In addition, the sides and back of the cabinet preferably contain a dado joint so that the shelf substrate is captivated within the sides and back of the cabinet. The cabinet may also include metal rods to support each shelf substrate. The sides of the cabinet are attached by screws passing through the sides into the metal rods so there is a direct metal-to-metal connection. The combination of the metal rods and captivated shelves provides a cabinet that is very strong and durable, and can be repaired very easily and economically.

15 Claims, 6 Drawing Sheets

CABINET WITH A SHELF THAT HAS A REMOVABLE SHELF LINER AND END CAP

BACKGROUND

1. Technical Field

This disclosure generally relates to cabinets, and more specifically relates to cabinets with shelves.

2. Background Art

Cabinets with and without shelves have been developed in many shapes and sizes. Cabinets with shelves come in a variety of different materials and configurations for a variety of different purposes. Cabinets with shelves provide a convenient way to store many different items without having to build shelves directly into a certain space. Cabinets can be prebuilt and delivered preassembled. Cabinets can also be prebuilt and delivered in pieces for easy assembly on site.

Cabinets are made of a variety of different materials depending on how and where the cabinet will be used. Metal cabinets can be very durable, but typically do not provide a decorative appearance. Wooden cabinets are typically used for kitchens, bathrooms, and other areas because the appearance of the cabinets may be customized according to wood type, cabinet design and finish to complement a room's decor. Plastic cabinets are typically light and inexpensive, but are generally less durable than metal or wood cabinets, and often do not provide a desired appearance for many applications. Thus there are tradeoffs in the selection of cabinet materials depending on where the cabinet will be used and what the cabinet will be used to store. As the cabinets are used, they may get damaged and need to be replaced. Replacing damaged cabinets is usually just as costly as initially purchasing and installing the cabinets, which can be quite expensive.

One type of cabinet that must be very rugged and durable are cabinets for band instruments. Band instruments are often put by students or other musicians into a band cabinet without much thought of the damage caused to the cabinet. Large band instruments are often banged against the front or flat part of the shelf, which can cause significant damage to a wood cabinet. Additionally, sheet music is often thrown into the same place in the cabinet as the instrument. For prior art band cabinets that have shelves that slide between the sides of the cabinet, there are small gaps between the shelves and the sides of the cabinet through which sheet music may easily fall. Thus, sheet music in prior art band cabinets may fall down between the shelf and the side of the cabinet into the space below the cabinet, making the music appear lost to the musician who put the sheet music in the band cabinet. A cabinet is needed that is durable, relatively inexpensive, and easily repaired, and that prevents sheet music from falling between the shelf and the side of the cabinet.

BRIEF SUMMARY

A cabinet includes a shelf substrate supported by metal rods. The sides of the cabinet are attached by screws passing through the sides into the metal rods so there is a direct metal-to-metal connection. The cabinet includes one or more shelves that each include a substrate, a removable shelf liner, and a removable end cap. When the removable shelf liner or removable end cap needs to be replaced, either one or both of the removable shelf liner and removable end cap can be easily removed and replaced without removing or replacing the shelf. In addition, the sides and back of the cabinet preferably contain a dado joint so that the shelf substrate is captivated within the sides and back of the cabinet. The combination of the metal rods and captivated shelves provides a cabinet that is very strong and durable. In addition, the removable shelf liner and end cap on each shelf may be individually replaced when they get damaged. The result is a rugged cabinet that has removable parts where the wear is most likely to occur, allowing easy repair of the removable parts without removing or replacing the shelf substrate.

The foregoing and other features and advantages will be apparent from the following more particular description, as illustrated in the accompanying drawings.

BRIEF DESCRIPTION OF THE SEVERAL VIEWS OF THE DRAWING(S)

The disclosure will be described in conjunction with the appended drawings, where like designations denote like elements, and:

DETAILED DESCRIPTION

A cabinet includes a shelf substrate that is supported by metal rods and captivated between the sides of the cabinet. A removable shelf liner sits on top of the shelf substrate. A removable end cap covers the front of the shelf substrate and the removable shelf liner and attaches the removable shelf liner to the shelf substrate. When the removable shelf liner or removable end cap needs to be replaced, the removable end cap and removable shelf liner can be easily removed and replaced without disassembling the cabinet and without removing or replacing the shelf substrate.

Figure 1:
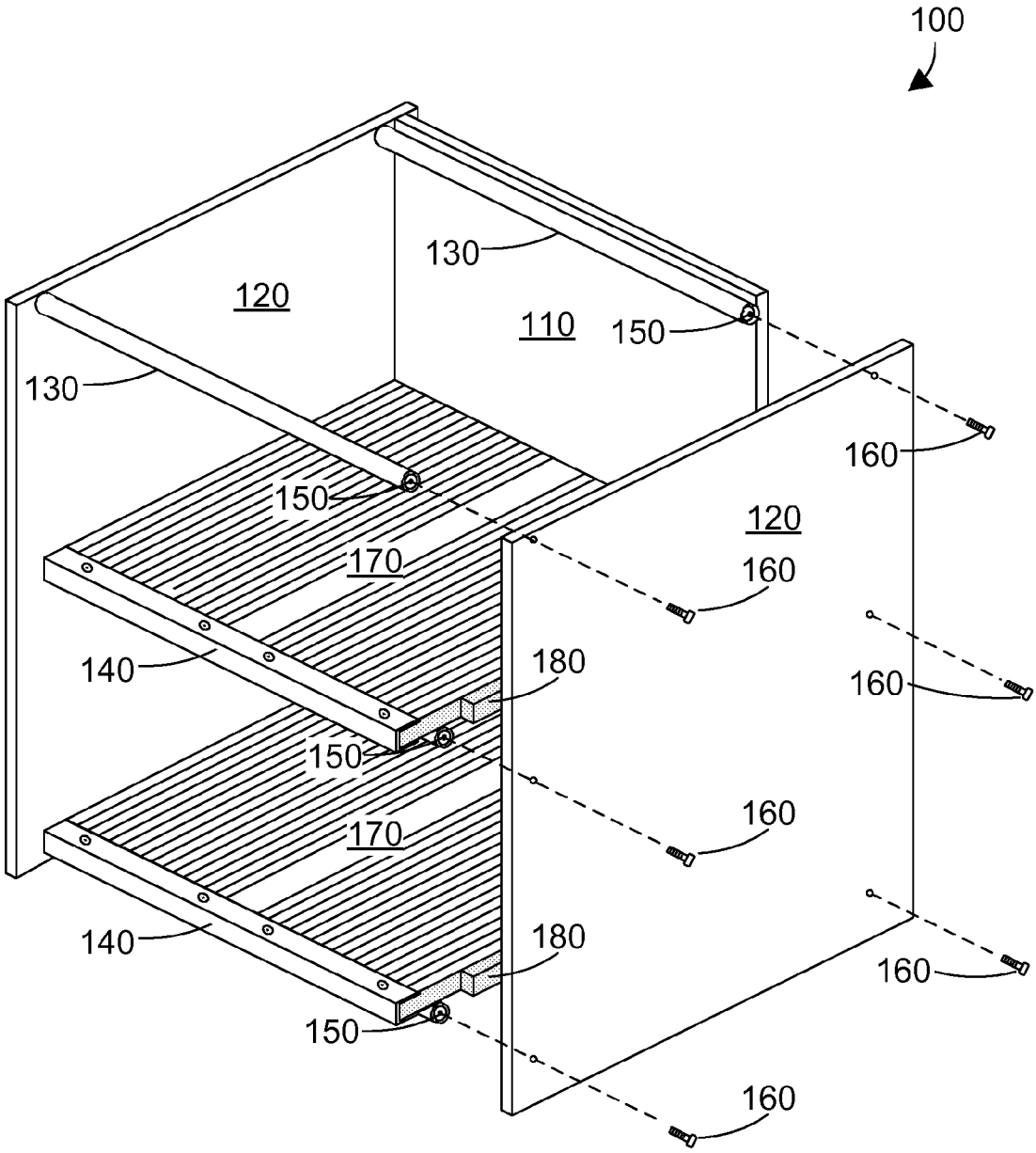
FIG. 1 is a partially exploded perspective view of a cabinet that includes a shelf that has a shelf substrate, a removable shelf liner, and a removable end cap that secures the removable shelf liner to the shelf substrate.

A cabinet 100 and its components are shown in various views in the figures. Referring to FIG. 1, cabinet 100 includes a back 110 and sides 120. Back 110 and sides 120 of cabinet 100 are preferably made of medium-density fiberboard (MDF), but could also be made of natural or processed wood products, metal, plastic, fiberglass, composite material, or any other suitable natural or synthetic material or combination of suitable materials. Cabinet 100 includes at least one shelf supported by metal rods 130. The preferred implementation of metal rod 130 is a hollow metal tube with threaded inserts 150 at each end. Threaded inserts 150 can be welded in each end or compression fitted. In the most preferred implementation, the threaded inserts 150 are welded into each end of the metal rods 130. Another suitable implementation is for metal rod 130 to be solid metal with the ends drilled and tapped to provide internal threads that will engage the external threads of metal machine screws. Metal rods 130 are fixed between sides 120 parallel to back 110. Sides 120 are attached to each other via metal rods 130. A metal machine screw 160 passes through a hole in side 120 into threaded insert 150 in metal rod 130. Metal machine screw 160 passing through a side 120 and then into threaded insert 150 in metal rod 130 results in a direct metal-to-metal connection which greatly increases the strength and durability of cabinet 100. Problems can arise when machine screws are threaded directly into the cabinet sides, back, or shelves as the connection holes in wood or other non-metal cabinets may strip out and become ineffective. The direct metal-to-metal connection described and claimed herein overcomes this problem. While metal machine screws are disclosed herein to connect the sides of the cabinet to the metal rods, it is equally within the scope of the disclosure and claims herein to use any suitable fastener, whether metal or not.

Cabinet 100 also includes at least one shelf. Each shelf comprises a shelf substrate 180, a removable shelf liner 170, and a removable end cap 140. Shelf substrate 180 is preferably MDF, but could also be made of natural or processed wood products, metal, plastic, fiberglass, composite material, or any other suitable natural or synthetic material or combination of suitable materials. Each shelf substrate 180 is supported by metal rods 130. In the preferred implementation, each shelf substrate 180 is supported by two metal rods 130. However, additional metal rods could be added for each shelf substrate 180 to increase the weight-bearing capacity of the shelf. In the specific implementation shown in the figures, cabinet 100 contains two metal rods 130 at the top of cabinet 100 that do not support a shelf substrate 180, two metal rods 130 that support a shelf substrate 180 at the bottom of cabinet 100, and two metal rods 130 that support a shelf substrate 180 between the top and the bottom of cabinet 100. Additionally there could be two metal rods for each additional shelf desired in cabinet 100. While the figures show cabinet 100 containing two shelves supported by metal rods 130 in the middle and the bottom of cabinet 100, the disclosure and claims herein extend to cabinets that contain only one shelf and cabinets that contain more than two shelves.

Figure 4:
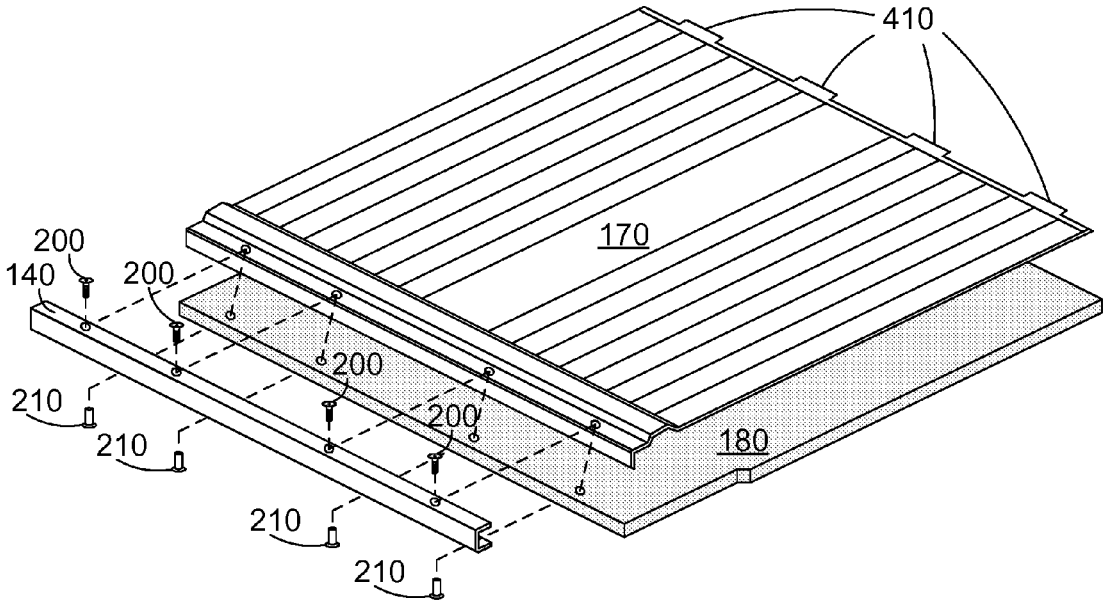
FIG. 4 is an exploded perspective view of a shelf in the cabinet.
Figure 5:
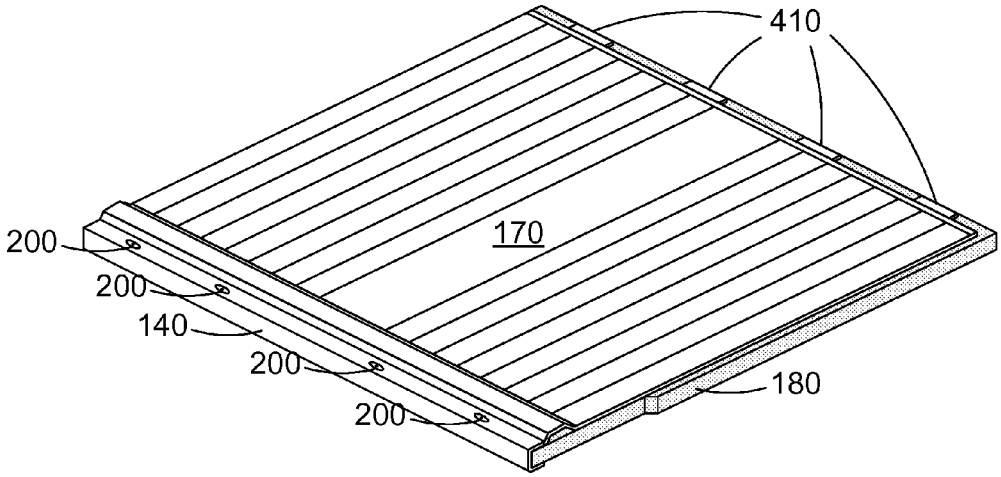
FIG. 5 is a perspective view of a shelf in the cabinet.

Back 110 and sides 120 preferably contain a dado joint for a shelf substrate 180 for each shelf in cabinet 100. In the preferred implementation, sides 120 contain a dado joint with a length that is less than the full depth of side 120, and a width that is slightly wider than the width of shelf substrate 180. Note the term "slightly wider" as used herein denotes the size of the dado joint is just wide enough to receive the shelf substrate. In another suitable implementation, sides 120 contain a dado joint along the full length of side 120. The shelf substrate resting in the dado joint ensures that things such as sheet music cannot fall from one shelf to the shelf or space below. This is especially applicable with shelves in band cabinets. Often sheet music is thrown into the shelf with the instrument. In prior art band cabinets with removable shelves, the thin sheets of music can slip between the shelf and the side of the cabinet, resulting in the sheet music traveling from one cabinet compartment to the cabinet compartment below. This makes retrieval of the music difficult, and may lead the musician to believe the music is lost. The dado joint ensures that music cannot fall past the shelf because the shelf substrate is recessed and captivated in the sides of the cabinet. The less-than-full-length dado joint ensures that things will not fall through the side of the shelf while also making it so that the dado joint is not visible from the front of the cabinet. This makes the cabinet more pleasing to the eye and increases the structural integrity of the cabinet. The shelf substrate interlocking with sides 120 result in a shelf substrate with a notch, as shown in FIGS. 1 and 4-5. This notch can be square as shown in FIG. 1 or slanted as shown in FIGS. 4-5. In addition, while the implementation shown in the figures includes a straight side edge for the substrate that goes into a single dado joint, it is equally within the scope of the disclosure and claims herein to provide multiple tabs on the side of the shelf substrate that engage multiple dado joints.

Figure 6:
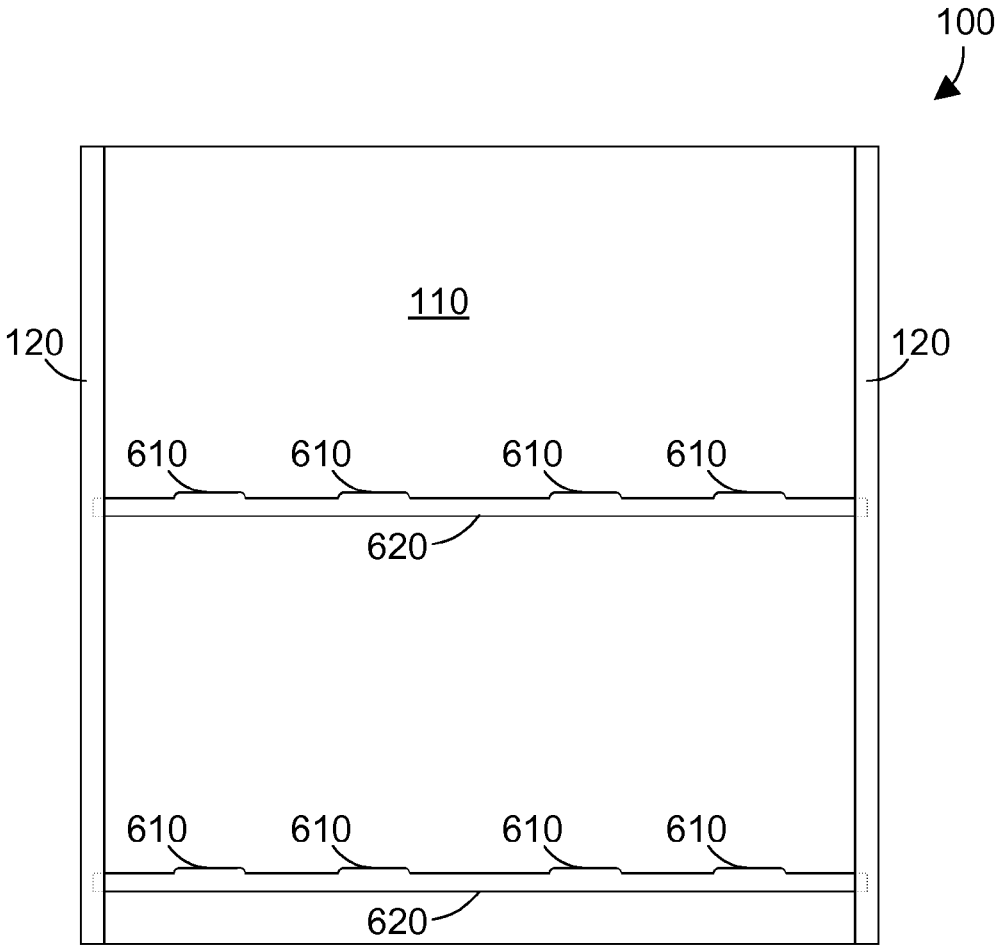
FIG. 6 is a front view of the cabinet without the shelves.

In addition to shelf substrate 180, each shelf preferably includes a removable shelf liner 170. One suitable implementation for removable shelf liner 170 has raised ridges to reduce the surface friction of removable shelf liner 170. This allows a band instrument to be more easily slid into band cabinet 100. Another suitable implementation is for removable shelf liner 170 to be a flat piece of material. Removable shelf liner 170 sits on top of shelf substrate 180, and in one implementation also wraps around the front of shelf substrate 180. In another implementation removable shelf liner 170 is flush with the front of shelf substrate 180. Back 110 preferably includes a dado joint along the width of back 110. In one implementation, the back of removable shelf liner 170 has tabs 410 as shown in FIGS. 4-5. Thus the dado joint in back 110 is slightly wider than the width of shelf substrate 180 along the full length of back 110 with additional width in the dado joint that matches the tabs in removable shelf liner 170. This is shown in FIG. 6, which is a front view of cabinet 100 without any of the shelves or metal rods 130. Note that back 110 contains a dado joint 620 that runs the entire length of back 110 and is slightly wider than the width of shelf substrate 180. Note also that back 110 contains additional dado joints 610 that correspond to the tabs on the back end of removable shelf liner 170. Note also in the most preferred implementation shown in the figures that the dado joints in sides 120 do not run the full length of sides 120, and as a result are only visible from the front of cabinet 100 in phantom, as shown in FIG. 6.

In another implementation, the back end of removable shelf liner 170 is flat and the entire back end fits within the dado joint on back 110 of cabinet 100. Thus back 110 of cabinet 100 would have a dado joint with a length the width of back 110 and a width slightly wider than the sum of the width of shelf substrate 180 plus the width of removable shelf liner 170. In one suitable implementation removable shelf liner 170 is made of plastic. In another suitable implementation, liner 170 is made of thin metal. Of course, any suitable material could be used for shelf liner 170.

In addition to a shelf substrate 180 and a removable shelf liner 170, each shelf preferably includes a removable end cap 140. Removable shelf liner 170 is preferably attached to shelf substrate 180 via removable end cap 140. Of course, the shelf liner 170 could also be attached to the shelf substrate 180 separately from the end cap 140. Removable end cap 140 preferably rests on top of removable shelf liner 170, wraps around the front of removable shelf liner 170 and shelf substrate 180, and wraps underneath shelf substrate 180. Fasteners 200 and 210 shown in FIGS. 2 and 4 pass through the top of removable end cap 140, through removable shelf liner 170, through shelf substrate 180, and through the bottom of removable end cap 140. In one implementation, removable end cap 140 is made of the same material as removable shelf liner 170. In another suitable implementation, removable end cap 140 is made of a different material as removable shelf liner 170. Removable end cap 140 can be made of plastic, metal, or any other suitable material, whether natural or synthetic. While the disclosure and drawings herein show fasteners passing through the individual pieces, another suitable implementation is to have removable end cap 140 designed and fitted in such a way that it snaps into place around removable shelf liner 170 and shelf substrate 180. For example, the end cap 140 could have tabs that are spread apart when the end cap 140 is being pressed onto the shelf substrate 180, with both the shelf liner 170 and the shelf substrate 180 having small recesses into which the tabs may snap, thereby locking the end cap 140 in position without any fasteners that penetrate the shelf substrate 170.

Figure 2:
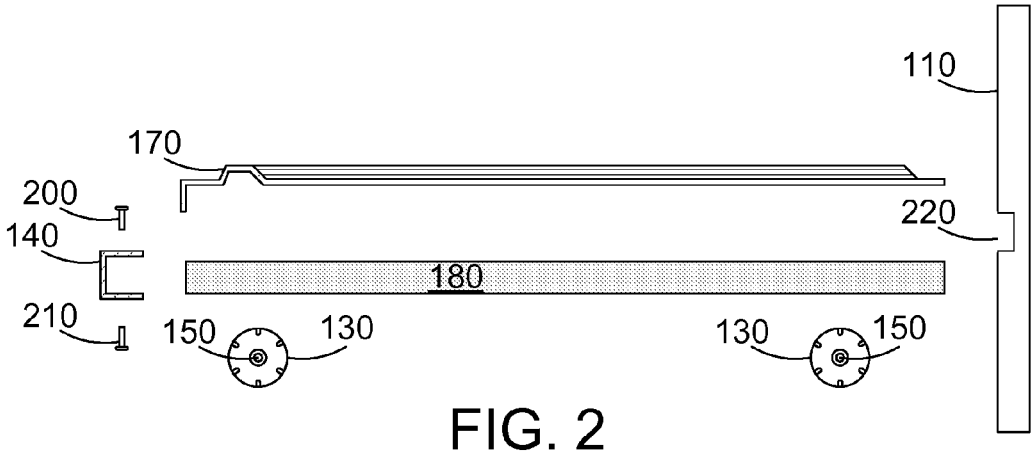
FIG. 2 is an exploded cross-sectional side view of a shelf in the cabinet.

FIG. 2 shows an exploded side view of one shelf in cabinet 100. Each shelf contains a shelf substrate 180 supported by at least two metal rods 130, a removable shelf liner 170, and a removable end cap 140. Back 110 is shown with dado joint 220. Notice dado joint 220 has a width slightly wider than the sum of the width of shelf substrate 180 plus the width of the back portion of removable shelf liner 170. The cross-section shown in FIG. 2 discloses either implementation of removable shelf liner 170 discussed above, where removable shelf liner has tabs on the back side as shown in FIGS. 4 and 5 or is flat across the back side. For the implementation of removable shelf liner 170 having a flat back side, then FIG. 2 is a cross-section of any part of the shelf. For the implementation of removable shelf liner having a tabbed back side as shown in FIGS. 4 and 5, then the cross-section shown in FIG. 2 is on one of the tabs. Note that removable shelf liner 170 is also shown in FIG. 2 to have raised ridges to reduce the surface friction of removable shelf liner 170. Note also that removable shelf liner 170 is shown to wrap around the front of shelf substrate 180. While removable shelf liner 170 is shown to wrap around the front of shelf substrate 180, it is equally suitable to have removable shelf liner 170 flush with the front of shelf substrate 180.

Figure 3:
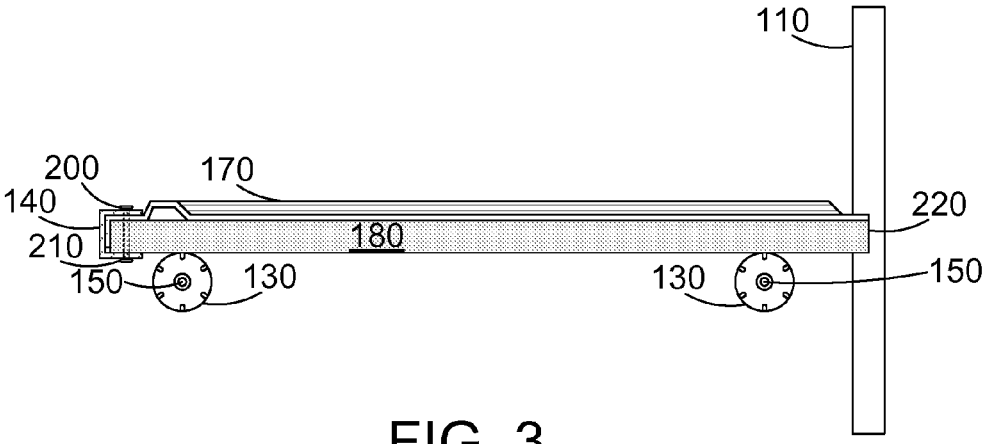
FIG. 3 is a cross-sectional side view of a shelf in the cabinet.

FIG. 3 shows the shelf in FIG. 2 as assembled in cabinet 100. Note how shelf substrate 180 and removable shelf liner 170 fit within dado joint 220 in back 110. Note also fastener 200 passes through the top of removable end cap 140, through removable shelf liner 170, and into shelf substrate 180, while fastener 210 passes through the bottom of removable end cap 140 and into shelf substrate 180. One of the fasteners 200 and 210 preferably includes external threads while the other includes internal threads, with the length of the fasteners 200 and 210 being greater than the height of the end cap 140, allowing the two fasteners 200 and 210 to be screwed together, thereby captivating the end cap 140 and shelf liner 170 to the shelf substrate 180. As shown in FIG. 3, back end of removable shelf liner 170 is secured by being within dado joint 220 and front end of removable shelf liner 170 is secured by removable end cap 140. In the specific implementation shown in the figures, these are the only points where removable shelf liner is secured to cabinet 100.

FIG. 4 shows an exploded perspective view of one shelf in cabinet 100. Notice how fastener 200 passes through the top of removable end cap 140, through removable shelf liner 170, into shelf substrate 180. Fastener 210 passes through the bottom of removable end cap 140 and into shelf substrate 180. Note that removable shelf liner 170 is also shown in FIG. 4 to have raised ridges to reduce the surface friction of removable shelf liner 170.

FIG. 5 shows a perspective view of one shelf in cabinet 100 as assembled. Notice the tabs 410 on the back end of removable shelf liner 170 are preferably flush with the back end of shelf substrate 180. The width of shelf substrate 180 is wider than the width of removable shelf liner 170, which allows the sides of shelf substrate 180 to be captivated within the dado joints in sides 20 while the removable shelf liner 170 covers the portion of shelf substrate 180 between the sides 120. This allows the removable shelf liner 170 to be easily removed and replaced even thought the shelf substrate 180 is securely captivated within cabinet 100.

Figure 7:
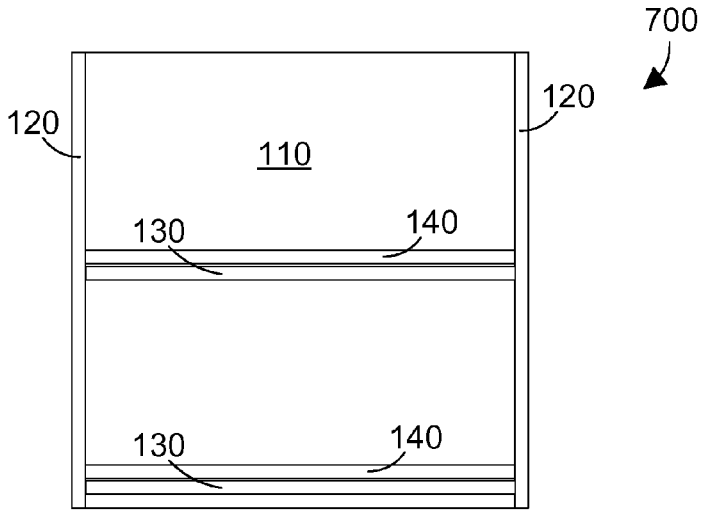
FIG. 7 is a front view of one cabinet.
Figure 8:
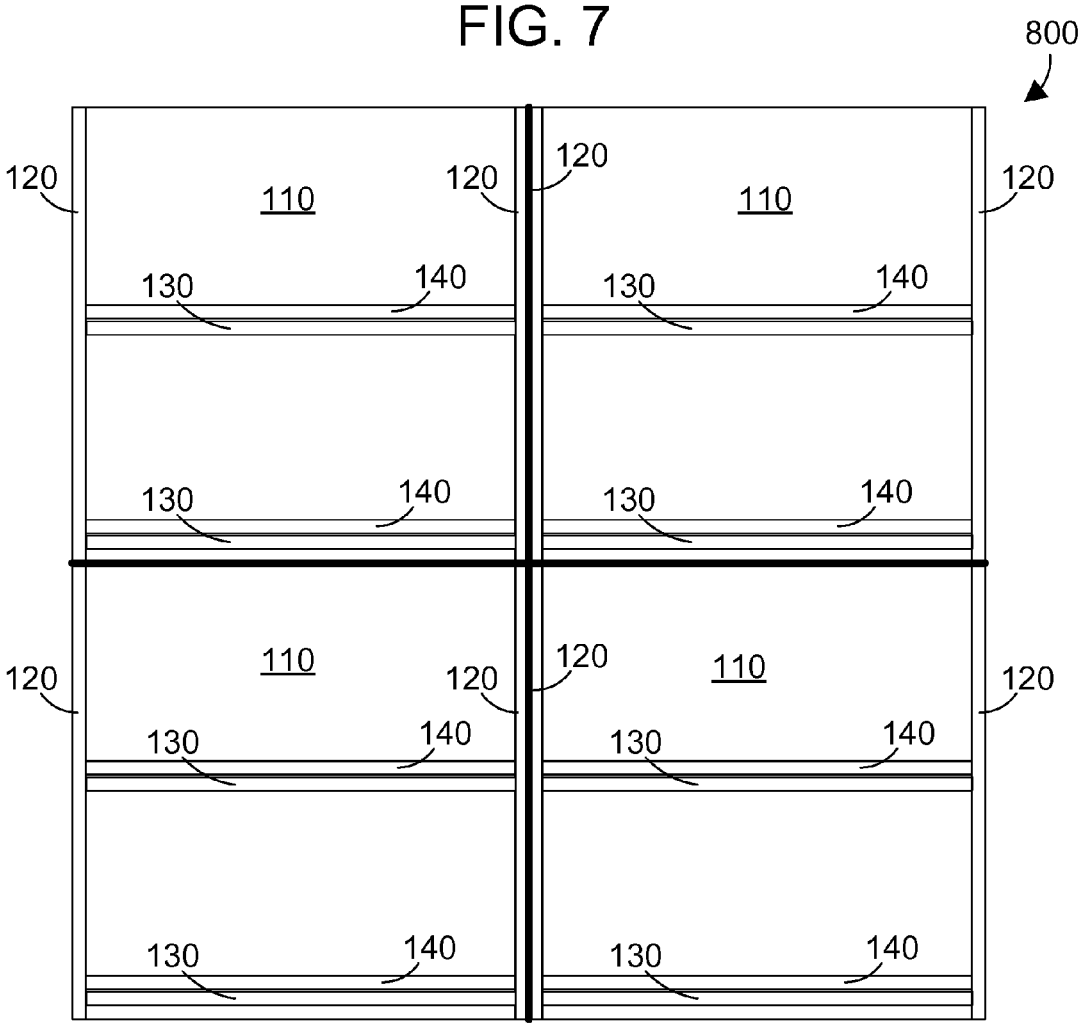
FIG. 8 is a front view of four cabinets ganged together.

FIG. 7 shows a front view of a single cabinet 700, which is one suitable implementation for cabinet 100 in FIGS. 1-6. FIG. 8 shows how four of the single cabinets 700 shown in FIG. 7 can be ganged together to form a series of usable cabinets. Note the cabinets 700 in FIG. 8 are separated by four bold lines to visually indicate the presence of the four separate cabinets. The four cabinets may be attached to each other using any suitable means. In the most preferred implementation, the sides of the cabinets have holes in the same locations, allowing metal fasteners similar in configuration to fasteners 200 and 210 in FIGS. 2-4 to be passed through the holes and tightened, thereby coupling the separate cabinets 700 together. Thus rather than custom building cabinets for a unique space, the cabinet units can be uniformly manufactured, the assembled on-site to meet the customer's needs. This allows the price to be cheaper because the cabinets can be mass manufactured in a uniform size, then assembled together to create an overall cabinet system that fits in the available space.

Figure 9:
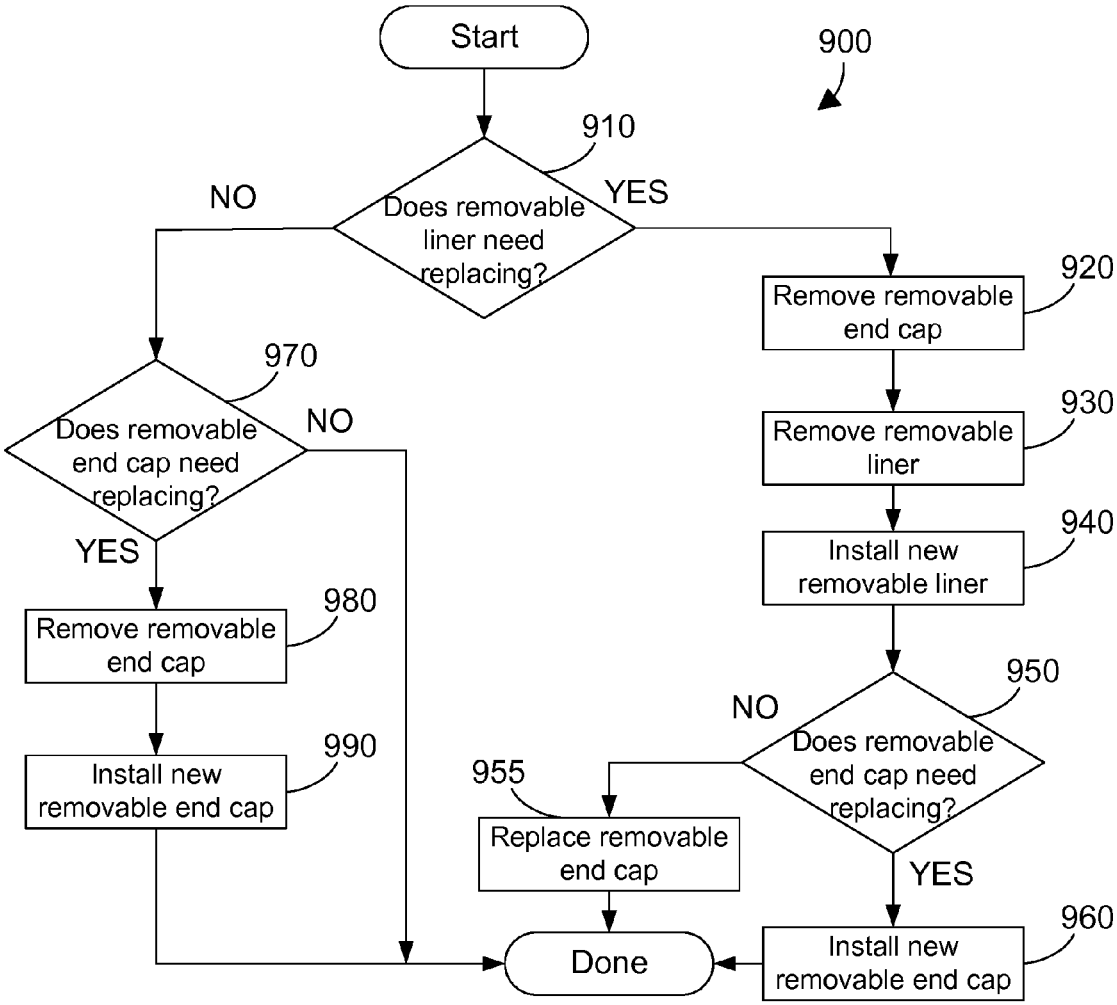
FIG. 9 is a method for repairing a shelf in the cabinet.

FIG. 9 shows a method 900 for repairing a cabinet that has been damaged. Method 900 begins by determining if a removable shelf liner needs to be replaced (step 910). If the removable shelf liner needs to be replaced (step 910=YES), then the removable end cap that captivates the removable shelf liner is removed from the cabinet (step 920). The removable shelf liner is removed (step 930) and a new removable shelf liner is installed into the cabinet (step 940). If the removable end cap also needs to be replaced (step 950=YES), then a new removable end cap is installed (step 960) and method 900 is done. If the removable end cap does not need to be replaced (step 950=NO), then the old removable end cap is replaced (step 955) and method 900 is done. If the removable shelf liner does not need to be replaced (step 910=NO), then method 900 moves to step 970. If the removable end cap needs to be replaced (step 970=YES), then the removable end cap is removed (step 980), a new removable end cap is installed (step 990) and method 900 is done. If the removable end cap does not deed to be replaced (step 970=NO), then method 900 is done.

A simple example is now given to illustrate the advantages of the cabinet disclosed herein. While the example is given in terms of a band cabinet, the claims and disclosure extend to any application of the cabinet described herein. Prior art band cabinets are used to store band instruments. Band instruments vary in size and weight. Depending on the size of the instrument, multiple instruments may be assigned to a single cabinet shelf, or a single instrument may occupy an entire shelf. Often sheet music is stored in the same cabinet as the band instruments. In prior art band cabinets that have movable shelves, often sheet music falls from one shelf between a gap between the side of the shelf and the cabinet side, and into the shelf or space below. This can result in the frustration or loss of the music.

Additionally, as the instruments are put into and taken out of the cabinet, not much thought is given to the cabinet. The shelves in a cabinet can be damaged quite easily by regular use because of the weight of certain instruments and the hard cases that band instruments are kept in. Damage to the shelves can cause the cabinet to not work properly and may cause potential danger to the musicians. With prior art cabinets, once the shelves become damaged, the entire shelf or cabinet had to be replaced. Replacing an entire cabinet is expensive when much of the cabinet may still be usable. In the prior art, the alternative to replacing a partially damaged cabinet is to continue using the damaged cabinet, which may be unattractive and may not function as needed.

For the example herein we assume we have three shelves that are used to store band instruments. These three shelves could all be contained in a single cabinet, or could be one shelf in three different cabinets. With the advantages of the cabinet discussed herein, as band instruments damage a shelf, a removable shelf liner or removable end cap can easily, quickly, and economically be replaced. For this example, we assume the first shelf has a damaged removable end cap, the second shelf has a damaged removable shelf liner, and the third shelf has both a damaged end cap and a damaged removable shelf liner.

For the first shelf, removable shelf liner 170 does not need to be replaced (step 910=NO), but the removable end cap (140 in FIGS. 1-5) does (step 970=YES in FIG. 9). The removable end cap is removed (step 980 in FIG. 9) and a new removable end cap is installed (step 990 in FIG. 9). Thus in a few quick steps the first shelf has been repaired with a new end cap and is ready to be used.

For the second shelf, the removable shelf liner (170 in FIGS. 1-5) is damaged (step 910=YES in FIG. 9) but the end cap 140 is not. The removable end cap is removed (step 920 in FIG. 9), and the removable shelf liner is removed (step 930 in FIG. 9). A new removable shelf liner is installed into the cabinet (step 940 in FIG. 9). Since the removable end cap is not damaged for the second shelf (step 950=NO in FIG. 9), the old removable end cap is replaced (step 955 in FIG. 9). Again, in a few quick steps the second shelf has been repaired with a new shelf liner, and is ready to be used.

For the third shelf, the removable end cap (140 in FIGS. 1-5) is damaged, and the removable shelf liner (170 in FIGS. 1-5) is also damaged (step 910=YES in FIG. 9). The removable end cap is removed (step 920 in FIG. 9), and the removable shelf liner is removed (step 930 in FIG. 9). A new removable shelf liner is installed (step 940 in FIG. 9), and since the removable end cap needs to be replaced (step 950=YES in FIG. 9), a new removable end cap is also installed (step 960 in FIG. 9). Again, in a few quick steps, the third shelf has been repaired with both a new shelf liner and new end cap, and is ready to be used.

In addition to the shelf liners and end caps being easily replaced, the shelf substrate being captivated in the dado joint makes it so that no matter how much music is thrown into the cabinet, and no matter how much rustling and jarring the cabinet may receive, the music cannot fall through to the shelf or space below. Even if the shelves get damaged, it is the removable end cap and removable shelf liner that will typically get damaged by the loading and unloading of instruments, not the shelf substrate. A shelf liner and end cap can be quickly and easily replaced. In addition, it is also much more cost effective in both time and resources to only replace a removable shelf liner or end cap rather than replace the entire shelf or cabinet.

The cabinet disclosed and claimed herein may have an open front, or may have suitable doors attached. Any suitable type and configuration of door could be used, including without limitation wire doors, wooden doors, plastic doors, etc.

The construction of the cabinet disclosed and claimed herein makes the cabinet very strong and durable. The shelf substrate is captivated within dado joints in the sides and back of the cabinet. In addition, metal rods beneath the shelves provide support for the shelves and provide a very secure connection between the sides of the cabinet. The result is a cabinet that can hold even the heaviest instruments without risk of deformation or failure, while providing removable shelf liners and end caps that make repairing the cabinet very simple and economical.

One skilled in the art will appreciate that many variations are possible within the scope of the claims. Thus, while the disclosure is particularly shown and described above, it will be understood by those skilled in the art that these and other changes in form and details may be made therein without departing from the spirit and scope of the claims.

The invention claimed is:

1. A cabinet comprising:

a back;

a first side;

a second side;

a shelf substrate that is captivated in a fixed position between the first and second sides, wherein the shelf substrate has a top, a bottom, a front, a back, a left side, and a right side, wherein the first side of the cabinet has a first dado joint that terminates before a front of the first side, where the first dado joint receives the left side of the shelf substrate and the second side of the cabinet has a second dado joint that terminates before a front of the second side, where the second dado joint receives the right side of the shelf substrate;

a removable shelf liner on the top of the shelf substrate that has a front and a back, wherein the front of the removable shelf liner includes:

a first portion that covers a front portion of the top of the shelf substrate; and a right-angle portion extending from the first portion that extends to cover at least a portion of the front of the shelf substrate; and a removable end cap separate from the removable shelf liner that includes a top, a front and a bottom, wherein the top of the removable end cap overlaps the first portion of the removable shelf liner, the front of the removable end cap substantially covers the right angle portion of the removable shelf liner and substantially covers the front of the shelf substrate, and the bottom of the removable end cap overlaps a front portion of the bottom of the shelf substrate, thereby captivating the front of the shelf substrate and the front of the removable shelf liner.

2. The cabinet of claim 1 further comprising a plurality of metal rods between the first side and second side of the cabinet that connects the first side of the cabinet to the second side of the cabinet and supports the shelf substrate.

3. The cabinet of claim 2 wherein each of the plurality of metal rods comprises a hollow metal tube with threaded inserts in each end of the hollow metal tube.

4. The cabinet of claim 2 wherein each of the plurality of metal rods comprises a solid metal rod with internal threads on each end.

5. The cabinet of claim 2 wherein each of the plurality of metal rods is connected to the right side and the left side of the cabinet by a metal screw that passes through the first side and the second side of the cabinet such that there is a direct metal-to-metal connection between the metal screw and the metal rod.

6. The cabinet of claim 1 wherein the first dado joint on the first side of the cabinet extends from the back of the first side towards the front of the first side to less than the full depth of the cabinet, and wherein the second dado joint on the second side of the cabinet extends from the back of the second side towards the front of the second side to less than the full depth of the cabinet.

7. The cabinet of claim 1 wherein the back of the cabinet comprises a third dado joint that receives the back of the shelf substrate and the back of the removable shelf liner.

8. The cabinet of claim 7 wherein the removable shelf liner comprises tabs on the back and the third dado joint on the back of the cabinet comprises a width that receives the back of the shelf substrate and the tabs on the back of the removable shelf liner.

9. The cabinet of claim 1 wherein the removable end cap captivates the shelf substrate front side and the removable shelf liner front side with a plurality of fasteners that pass through the removable end cap, the removable shelf liner, and the shelf substrate.

10. The cabinet of claim 1 wherein the removable shelf liner comprises ridges to reduce the surface friction of the removable shelf liner.

11. The cabinet of claim 1 wherein the shelf substrate comprises medium-density fiberboard.

12. The cabinet of claim 1 wherein the removable shelf liner comprises plastic.

13. The cabinet of claim 1 wherein the removable end cap comprises plastic.

14. The cabinet of claim 1 wherein the removable end cap captivates the removable shelf liner and the shelf substrate using a plurality of fasteners that pass through the removable end cap, through the removable shelf liner, and through the shelf substrate.

15. A cabinet comprising:

a back;

a first side;

a second side;

a shelf substrate that is captivated in a fixed position between the first and second sides, wherein the shelf substrate has a top, a bottom, a front, a back, a left side, and a right side, wherein the shelf substrate is supported by a plurality of hollow metal tubes that each include threaded inserts in each end, the plurality of hollow metal tubes connecting the first side of the cabinet to the second side of the cabinet by metal screws that pass through one of the first and second sides of the cabinet such that there is a direct metal-to-metal connection between each metal screw and each threaded insert, wherein the first side and the second side of the cabinet have corresponding dado joints that each have a width slightly wider than a width of the shelf substrate and a length less than a depth of the cabinet from the back of the cabinet terminating before the front of the cabinet to contain the left side and the right side of the shelf substrate;

a removable shelf liner that has a front, a top, and a tabbed back, wherein the front of the removable shelf liner includes:

a first portion that covers a front portion of the top of the shelf substrate; and a right-angle portion extending from the first portion that extends to cover at least a portion of the front of the shelf substrate;

wherein the top of the removable shelf liner comprises ridges to reduce surface friction of the removable shelf liner, wherein the back of the cabinet has a dado joint with a width slightly wider than a sum of the width of the shelf substrate plus a width of the removable shelf liner that aligns with the tabbed back side of the removable shelf liner to contain the back side of the shelf substrate and the tabbed back side of the removable shelf liner; and a removable end cap separate from the removable shelf liner that includes a top, a front and a bottom, wherein the top of the removable end cap overlaps the first portion of the removable shelf liner, the front of the removable end cap substantially covers the right angle portion of the removable shelf liner and substantially covers the front of the shelf substrate, and the bottom of the removable end cap overlaps a front portion of the bottom of the shelf substrate, wherein the removable end cap captivates the shelf substrate front side and the removable shelf liner front side with a plurality of fasteners that pass through the removable end cap, the removable shelf liner, and the shelf substrate.

* * * * *